US008013542B2

(12) United States Patent
Endres

(10) Patent No.: US 8,013,542 B2
(45) Date of Patent: Sep. 6, 2011

(54) ELECTRONIC BALLAST FOR A LOW-PRESSURE DISCHARGE LAMP WITH A MICRO-CONTROLLER

(75) Inventor: Helmut Endres, Zusmarshausen (DE)

(73) Assignee: OSRAM AG, Munich (DE)

( * ) Notice: Subject to any disclaimer, the term of this patent is extended or adjusted under 35 U.S.C. 154(b) by 504 days.

(21) Appl. No.: 11/920,693

(22) PCT Filed: May 15, 2006

(86) PCT No.: PCT/DE2006/000832

§ 371 (c)(1),
(2), (4) Date: Feb. 20, 2009

(87) PCT Pub. No.: WO2006/122525

PCT Pub. Date: Nov. 23, 2006

(65) Prior Publication Data

US 2009/0212712 A1 Aug. 27, 2009

(30) Foreign Application Priority Data

May 17, 2005 (DE) ..... 10 2005 022 591

(51) Int. Cl.
*H05B 37/02* (2006.01)

(52) U.S. Cl. ..... 315/307; 315/224; 315/274; 315/294

(58) Field of Classification Search ..... 315/209 R, 315/224, 274, 276, 291, 294, 307–309, 312
See application file for complete search history.

(56) References Cited

U.S. PATENT DOCUMENTS

| | | | | |
|---|---|---|---|---|
| 4,594,531 | A * | 6/1986 | Ganser et al. | 315/307 |
| 4,730,147 | A | 3/1988 | Kroening et al. | |
| 5,030,887 | A | 7/1991 | Guisinger et al. | |
| 5,055,993 | A | 10/1991 | Miyata et al. | |
| 5,491,388 | A * | 2/1996 | Nobuyuki et al. | 315/308 |
| 6,040,662 | A * | 3/2000 | Asayama | 315/291 |
| 6,873,121 | B1 | 3/2005 | Stevens | |
| 7,221,103 | B2 * | 5/2007 | Siessegger | 315/274 |
| 2002/0047630 | A1 * | 4/2002 | Kastner | 315/291 |
| 2003/0155873 | A1 * | 8/2003 | O'Meara | 315/312 |
| 2004/0032223 | A1 | 2/2004 | Henry | |
| 2004/0251849 | A1 * | 12/2004 | Harada et al. | 315/209 R |
| 2005/0231132 | A1 * | 10/2005 | Powell | 315/291 |
| 2006/0082329 | A1 * | 4/2006 | Chang | 315/291 |

FOREIGN PATENT DOCUMENTS

| | | |
|---|---|---|
| DE | 39 03 520 | 8/1989 |
| DE | 101 08 016 | 8/2002 |
| WO | WO 01/43510 | 6/2001 |

* cited by examiner

*Primary Examiner* — Douglas W Owens
*Assistant Examiner* — Tung X Le

(57) ABSTRACT

The invention relates to an electronic ballast for a lamp, supplied with electrical energy from a power source, different to the mains AC network, comprising at least one electronic switch element for conversion of the supplied electrical power. According to the invention, a microcontroller controls the electronic switch element.

6 Claims, 2 Drawing Sheets

ELECTRONIC BALLAST FOR A LOW-PRESSURE DISCHARGE LAMP WITH A MICRO-CONTROLLER

TECHNICAL FIELD

The invention relates to an electronic ballast for a luminous means, such as, for example, a low-pressure discharge lamp, which can be fed with electrical energy by an energy source, which is different than the public AC system (230 V/400 V). The luminous means can be fed with DC voltage, in particular a low-volt DC voltage. The electronic ballast can, however, be designed for a luminous means which is operated with a low-volt AC voltage. The electronic ballast contains at least one electronic switching element for converting the fed-in intermediate energy.

PRIOR ART

In particular in the case of low-voltage and DC systems, such as for example in the sector of automobiles, vessels, in the camping sector and in the case of solar power islands, compact fluorescent lamps with an integrated electronic ballast are only used to a restricted extent. Previous circuits of electronic ballasts for this purpose use a freely oscillating push-pull converter or single transistor solutions, which have poor preheating and ignition properties. In some solutions, the preheating and ignition phase is controlled by means of a relay having an overall complex design including its driver circuit.

DESCRIPTION OF THE INVENTION

The object of the present invention is to improve an electronic ballast of the type described above in accordance with the precharacterizing clause of patent claim 1 in such a way that it responds in a flexible manner to various situations and nevertheless has a compact design.

This object is achieved by virtue of the fact that a microcontroller drives the electronic switching element.

A microcontroller allows for flexible driving of the electronic switching elements and therefore makes it possible to adapt to various situations which arise owing to the predetermined properties of the luminous means.

In accordance with the invention, the driving of the at least one electronic switching element can take place indirectly or directly, i.e. with a driver stage interposed or not.

The switching element may be a transistor, in particular a MOSFET. Particularly preferably, a logic level MOSFET is used because the input voltages of the logic level MOSFET allow the transistor to be controlled directly in a particularly simple manner from an output of the microcontroller.

In one advantageous embodiment, the electronic ballast comprises a transformer, which has at least one primary winding on the side of the switching element and which also has at least one secondary winding, which emits the electrical energy to the luminous means. As a result, the output voltage of the electronic ballast can be matched to the optimum operating voltage of the luminous means.

Various circuits are possible in which a microcontroller drives the electronic switching element. This is, for example, a push-pull output stage comprising two switching elements, the transformer then being designed in such a way that it has two identical primary windings, which are each connected to one of the switching elements.

Alternatively, a half-bridge output stage comprising two switching elements is used, the switching elements being connected to one another directly or indirectly via a node, and at least one primary winding of the transformer being connected to the node of the switching elements.

A full-bridge output stage can also be used which contains four switching elements. Of these four switching elements, in each case two are connected to one another via a node. The primary winding of the transformer is then connected to the two nodes.

The circuit may also contain a single switching element, in this case the transformer preferably having at least one further primary winding, which is used for demagnetization. This further primary winding can also feed back the magnetic energy stored in the transformer in the off phase of the switching element entirely or partially in a buffer capacitor.

In a further preferred embodiment, the supply voltage is supplied to a voltage divider, one of whose taps is connected to one input of the microcontroller. In this way, the microcontroller can identify and monitor the supply voltage.

Provision may also be made for a signal from a temperature sensor to be applied to one input of the microcontroller. This may be a temperature sensor which measures the temperature on the printed circuit board on which the microcontroller is fitted or else a temperature sensor of the lamp. The sensor may also be external. The evaluation of the temperature signal is used for protecting the luminous means because, in extreme situations, shutdown takes place or at least the luminous flux is matched.

The driving of switching elements by means of the microcontroller preferably takes place in a very specific way: The microcontroller emits pulse trains which are synchronized with one another at two outputs, synchronized being understood to mean that the pulse trains are matched to one another. Each pulse train comprises at least one pulse burst (which may also be "infinite" in length), an operating frequency and a duty factor as well as a pulse burst interval being defined by the pulse bursts (at the two outputs). The operating frequency results from pulses at the two outputs as a frequency at the lamp. The duty factor is the ratio of the switch-on time to the switch-off time for the driven switching elements. A single continuous pulse burst can be emitted, i.e. the operating frequency and the duty factor cannot be changed continuously. Preferably, the microcontroller emits a plurality of pulse bursts, however, which are each separated from one another by an interpulse period, as a result of which the pulse burst interval is defined. Not only the operating frequency and/or the duty factor can be variable, but also the pulse burst interval, a change in the pulse burst interval equaling a pulse width modulation at a frequency which is lower than the operating frequency.

The microcontroller can in particular change the power emitted to the luminous means via the operating frequency, the duty factor and the pulse burst interval and drive the lamp in a flexible manner owing to a clever temporal parameter sequence.

The individual pulses in the pulse bursts are preferably square-wave pulses, in each case a pulse at a second output following a pulse at a first output of the microcontroller. In a preferred embodiment, a dead time, which may be variable, lies between the pulses at the two outputs. A dead time has the advantage that the square-wave pulses are changed to trapezoidal pulses with the aid of a capacitor, which is preferably connected in parallel with the primary windings, with the result that the high-frequency interference spectrum is reduced and the complexity in terms of interference suppression is reduced. The variability of the dead time may be dependent on parameters such as the input voltage or other measured variables.

In a preferred embodiment of the electronic ballast in accordance with the invention, a resonant circuit is formed on the output side on the transformer with an inductance, which is provided in the output circuit, and a capacitor. A resonant circuit makes it possible in particular to achieve the excess voltage required for igniting a low-pressure discharge lamp by feeding in a power close to the resonant frequency.

The resonant circuit may include an inductance, which at least partially comprises the stray inductance of the output transformer. The output transformer can be connected for this purpose in such a way that the primary and secondary windings are split into at least two separate chambers, so that the stray inductance can be defined. A capacitor is provided as the second element in the resonant circuit, which capacitor is connected in parallel with the luminous means. In addition, a capacitor can be provided which is connected in series with the luminous means.

For the purpose of further flexibilization, provision may be made for a portion of the capacitance or a further capacitance to be capable of being connected or disconnected in the resonant circuit by the microcontroller via at least one further switching element. The connection or disconnection can take place as a function of the programming of the microcontroller or of measured variables present at its inputs. Owing to the connection and disconnection of the switching element, the resonant frequency in the resonant circuit is changed abruptly. This is a particularly advantageous configuration of the electronic ballast with the microcontroller because the driving of the luminous means can take place particularly precisely.

An RC element can be connected at an input of the microcontroller. This input can at the same time be in the form of an output, the microcontroller in each case passing the supply voltage on to the RC element. If the supply voltage is disconnected, the RC element gradually loses the voltage. It can therefore be seen from the RC element how long the supply voltage has been disconnected. This may be configured in such a way that the microcontroller establishes at its input whether the voltage at the RC element exceeds or falls below a certain threshold ("logic high" or "logic low"), but provision may even be made for the voltage, which is buffer-stored in the RC element, to be capable of being evaluated in linear fashion. This configuration is particularly helpful in the case of a lamp with a "vario" function, in which, following a short-term disconnection, when it is switched on again the lamp is only reactivated at a dimmed level, whereas, after a relatively long-term disconnection or redisconnection, it functions with the normal luminous power. The duration of the disconnection can be identified via the RC element.

In a further preferred embodiment, the microcontroller can receive a control signal from an infrared or radio controller, from the interface or from a signal which is superimposed on the supply voltage. In the case of a signal which is superimposed on the supply voltage, an evaluation of the supply voltage needs to take place in the interior of the microcontroller. Corresponding sensors can be made available at inputs of the microcontroller for the infrared or radio controller.

In a further preferred embodiment, the microcontroller drives additional luminous means, in particular light-emitting diodes or further low-pressure discharge lamps (indirectly or directly). This embodiment is advantageous in developed arrangements of electronic ballasts and luminous means in which a low-pressure discharge lamp is assisted by colored light-emitting diodes, emits a colored light together with said light-emitting diodes or, assisted by a low-pressure discharge lamp, overall emits a slightly brighter light. The driving of the additional luminous means can take place via a further switching element to a certain extent in parallel with the previous luminous means or else by means of a variation of output signals of the microcontroller, as a result of which, for example, a second low-pressure discharge lamp is ignited.

The driving of the additional luminous means can proceed in temporally predetermined fashion, with the result that, for example, a daily sequence can be impressed, in which more bluish light-emitting diodes are connected in the morning and more reddish light-emitting diodes in the evening, whereas towards midday the light radiation is maximized by an additional low-pressure discharge lamp. A natural light can therefore be imitated.

In a further preferred embodiment, displays are connected downstream of the microcontroller, on which displays information on the operating mode of the electronic ballast and/or the luminous means can be emitted. Output signals can also be output via an output of the microcontroller, which output signals reflect this information, for example via an interface. The microcontroller has the information on the operating mode of the electronic ballast owing to its internal programming or else owing to measured variables which are present at its inputs.

The electronic ballast according to the invention can form, together with a luminous means, an inseparable unit. Alternatively, electronic ballasts and luminous means are electrically connected to one another via a plug-type system, but can be separated from one another. With the two embodiments it is possible to equip the unit comprising the lamp and the electronic ballast with one of the conventional bases, for example E27 or B22d. A protective circuit may be provided which protects the circuit in the event of it unintentionally being used with the normal AC circuit of, for example, 230 V and 50 Hz. A protective circuit may also be provided which protects the supply circuit from a faulty lamp or else, in the event of the plug-type system, from a missing lamp, so that an unnecessarily high voltage at the output terminals or else merely unnecessary energy consumption is avoided.

BRIEF DESCRIPTION OF THE DRAWINGS

The invention will be explained in more detail below with reference to an exemplary embodiment. In the drawings.

PREFERRED EMBODIMENT OF THE INVENTION

Figure 1:
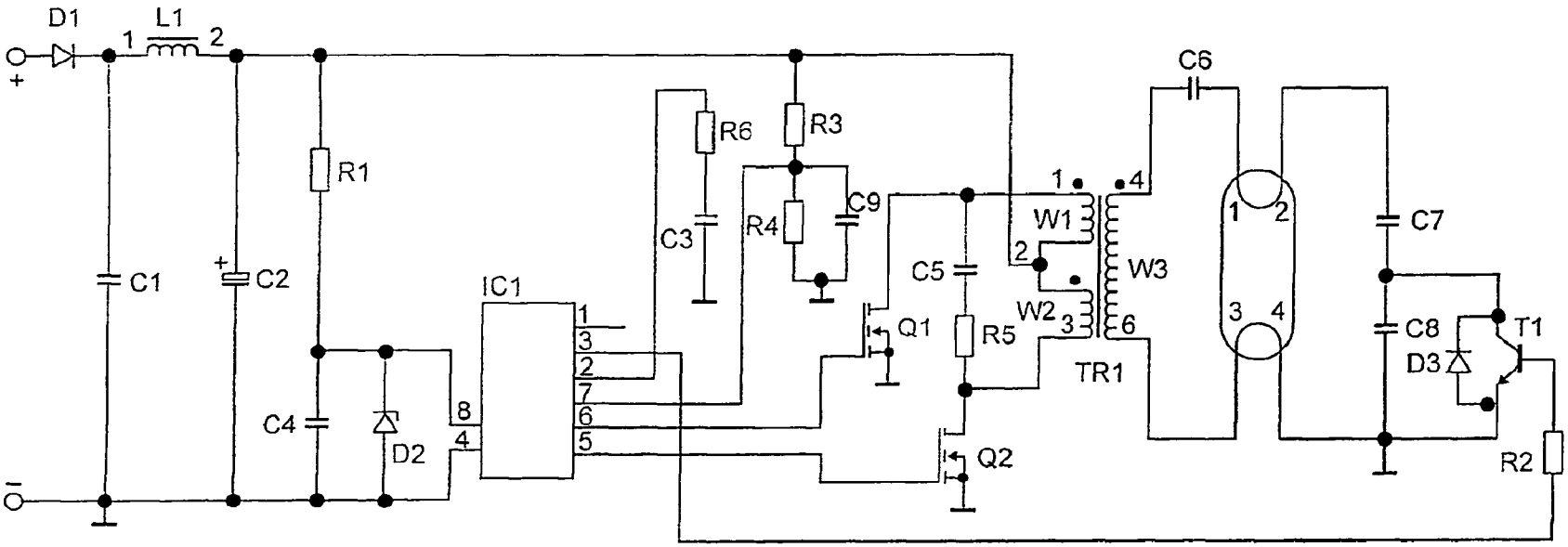
FIG. 1 shows the circuit of an electronic ballast according to the invention with an associated luminous means.

An electronic ballast in accordance with a preferred embodiment of the invention with a push-pull output stage is illustrated in FIG. 1. On the input side, the electronic ballast has an input filter, which comprises buffer capacitors C1 and C2 and an inductance L1 as an inductor.

The electronic ballast further comprises protection against polarity reversal for the input voltage. For this purpose, on the one hand a diode D1 is provided in series with one of the power supply lines of the DC voltage. In addition, a second diode D2 is arranged in the off direction, i.e. back-to-back in parallel with respect to the DC voltage at a low-pass filter comprising the elements R1 and C4. The supply voltage is therefore present at the inputs 4 and 8 of a microcontroller IC1.

A DC voltage, which represents the supply voltage, is likewise present at the input 7 of the microcontroller IC1 via a voltage divider comprising the elements resistor R3 on the one hand and resistor R4 and capacitor C9 on the other hand. Information relating to the supply voltage is therefore available to the microcontroller.

The connection 2 functions both as an input and as an output. An RC element comprising the resistor 6 and the capacitance C3 is arranged at this connection. The microcontroller IC1 outputs the supply voltage, which it obtains via the connections 4 and 8, via the output 2. If the supply voltage is switched off, the capacitor C3 is gradually discharged via the connection 2. The microcontroller IC1 can measure, at the connection 2 as the input, by how much the voltage at the capacitor C3 has dropped and thus determine how long the supply voltage has been switched off or was switched off. Owing to this measure, a "vario" operation of the low-pressure discharge lamp is made possible, which consists in the lamp being switched on in a dimmed state after only a short-term disconnection of the lamp and not being switched on in a state under full load.

Logic level MOSFETs Q1 and Q2 are provided as switching elements in the circuit according to the invention. These are driven via the outputs 5 and 6 directly by the microcontroller IC1. The MOSFET is connected directly to a primary winding W1 of a transformer, and the MOSFET Q2 is connected to a primary winding W2 (of equal size) of a transformer. A capacitor C5 together with a resistor R5 in parallel with the primary windings serves the purpose of lowering the high-frequency interference spectrum. Virtually square-wave pulses at the MOSFETs Q1 and Q2 are converted by the capacitor C5 into trapezoidal forms, as a result of which high-frequency components are switched off. A secondary winding W3 is provided on the other side of the transformer, at which secondary winding a low-pressure discharge lamp is present. In order to form an output-side resonant circuit, capacitors C6, C7 and C8 are provided. The capacitor C8 can be connected and disconnected, controlled via the output 3 of the microcontroller IC1 (by means of the transformer T1 via the resistor R2). As a result, the capacitance, which is connected in parallel with the luminous means, is decreased or increased.

In the illustration shown in FIG. 1, a connection 1 at the microcontroller IC1 is still free. This connection is available, for example, for a temperature sensor, which is located directly at the low-pressure discharge lamp in order that the microcontroller in this way contains information on the operating state of the low-pressure discharge lamp. The microcontroller IC1 could also have further connections, for example in total 16, with the result that further functionalities are available. These include the control of displays or of further luminous means, such as, for example, light-emitting diodes, which are included for emission by the low-pressure discharge lamp.

Figure 2:
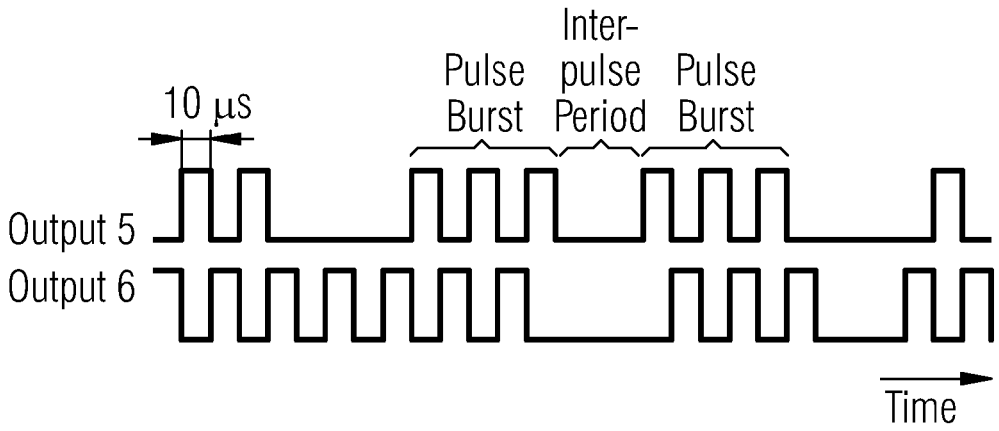
FIG. 2 shows an example of pulse trains, which are emitted by the microcontroller at its outputs.

By way of example, FIG. 2 shows signals which are emitted by the microcontroller at the outputs 5 and 6. The microcontroller in each case emits a pulse train at the two outputs, the two pulse trains being synchronized with one another to such an extent that no pulse is emitted at one output as long as a pulse is being emitted at the other output. Each pulse train comprises a plurality of pulse bursts, which are interrupted by interpulse periods, a regular train of pulses with a predetermined frequency and predetermined duty factor being emitted in each pulse burst. The duration of the pulses is in this case 10 microseconds, the duty factor being 50%, i.e. the switch-on time and switch-off time being equal in length. Not illustrated here is a dead time between two associated pulses at the output 5 and at the output 6. Within a pulse burst, pulses at the output 5 and at the output 6 alternate, i.e. pulses for the two control transformations Q1 and Q2. After an interpulse period, however, the sequence begins again with the pulse which was most recently emitted, with the result that the transistor which had received the last pulse prior to the interpulse period between the pulse bursts receives a pulse again first after the interpulse period. However, this does not necessarily have to be so; it would also be conceivable for the pulses to alternate with one another beyond the interpulse periods.

The square-wave pulses at the outputs 5 and 6 are transformed into a sinusoidal oscillation on the output side of the transformer TR1. In this case, each pulse corresponds to a half oscillation.

There are now a plurality of possibilities for the control. The interval between the pulses is variable. The duty factor, i.e. the width of the pulses, is also variable. These two variables can vary within each pulse burst. The length between the interpulse periods between the pulse bursts is also variable.

The control of the low-pressure discharge lamp takes place as described below:

Once the supply voltage has been connected, first filaments in the low-pressure discharge lamp are preheated in order to provide the prerequisite conditions for lamp ignition. First the operating ratio and duty factor, also as a function of the supply voltage which is detected at the input 7, are varied in order to preheat the filaments. First the operating frequency is higher than the resonant frequency in the above-described resonant circuit with the capacitors C6, C7 and C8. Once the supply voltage has been connected, a ramp function, which represents this increase, initially remains at such a high level that the resonant circuit is not sufficiently excited to bring about lamp ignition, but that at the same time the flowing currents bring about preheating of the filaments of the low-pressure discharge lamp. The operating frequency is then decreased continuously or in sufficiently small stages until it comes so close to the resonant frequency of the resonant circuit in the output of the transformer TR1 that a sufficiently excessive voltage is achieved for igniting the low-pressure discharge lamp. Overall, the preheating time should be as short as possible, with as high a preheating current as possible, but the frequency still needs to be kept sufficiently far removed from the pulse point of the resonant circuit during the preheating time in order to rule out any unintentional early ignition prior to the termination of the preheating phase. In this case, the frequency during the preheating is determined as a function of the supply voltage.

Once the low-pressure discharge lamp has been switched on, the power is first controlled such that it is at a relatively high level for a predetermined time in order to achieve an accelerated increase in the luminous flux of the low-pressure discharge lamp ("power boost"). This initial increase in power can be made dependent on the temperature of the surrounding environment and/or of the lamps; it may also be possible for a light sensor to detect the luminous flux of the low-pressure discharge lamp, and the power can be controlled in a corresponding manner.

The initially increased power can, after a predetermined time has elapsed, be brought back to the normal operating level continuously or in sufficiently small steps, in turn the abovementioned variables, in particular the operating frequency and/or the duty factor, being varied in corresponding fashion.

During operation of the lamp after the runup time, the emission of power to the low-pressure discharge lamp in the manner described with reference to FIG. 2 takes place in the form of the emission of a plurality of pulse bursts, interrupted by interpulse periods, in which virtually no power is transmitted to the luminous means, then with renewed power transmission, which results in intermittent operation with pulse width modulation with a lower frequency than the operating frequency. In this case, the frequency of the pulse bursts can be switched alternately in such a way that, after a specific type of positive and negative half oscillations of a specific frequency, there follows a further time span with another frequency, in which another power is transmitted to the luminous means (for heating the filaments), which results in an operation with pulse width modulation at a lower frequency than the operating frequency with different power levels, as a result of which the mean transmitted power is then set.

The capabilities for setting the power, in the same way as the frequency variation, the variation in the duty factor or the pulse width modulation with respect to the pulse bursts, can be used in particular for the purpose of entirely or partially compensating for the dependence of the emitted luminous efficiency on the input voltage.

Even during normal operation, the operating frequency can be used continuously, to be precise the operating frequency can be the subject of a frequency modulation ("wobbling"). As a result, very small and high peak values in the spectrum of the measured radio interference are avoided, and the interference suppression of the lamp corresponding to the guidelines is facilitated. Precisely this measure demonstrates the advantage which the invention has as a result of the use of a microcontroller in comparison with the use of conventional switching controllers.

The abovementioned free input 1 can also be used for connecting a sensor for a control signal. For example, this may be actuating signals for dimming the lamp. The dimming can take place in variable fashion or in stages, once again the capabilities of adjusting the power, in the same way as the variation of the operating frequency, the change in the duty factor or the pulse width modulation relating to the pulse bursts, being used. In the case of dimming, it may also be necessary to switch the capacitor C8 over via the output 3 of the microcontroller IC1 in order to increase the reactive power in the case of a severely dimmed lamp and therefore to ensure sufficient heating of the filaments of the low-pressure discharge lamp even in the case of low lamp currents.

The dimming can also take place in the so-called "vario" operating mode, i.e. after a short-term disconnection of the lamp and reconnection of the lamp, the lamp can emit the light in such a way that it is dimmed. As mentioned above, the evaluation of the voltages present at the RC element comprising the elements R6 and C3 at the input/output 2 of the microcontroller IC1 is used for this purpose.

As already mentioned, the microcontroller monitors the supply voltage at its input 7. In the case of a supply voltage which is too low or too high, the electronic ballast can change over to a previously established, different operating state in order to protect the entire lamp. A different operating state can be understood to mean a change in the power. In the case of a supply voltage which is too low, the voltage source can reduce the power consumed overall or even completely disconnect it, in which case the thresholds for reduction of the power and disconnection can be different.

The electronic ballast illustrated in FIG. 1 is very compact and can be accommodated easily in a compact manner in a component part which is fixedly connected to a low-pressure discharge lamp or connected to it via a plug, in this case it being possible for a plug to be provided for screwing the lamp into a conventional lampholder (E27 or B22d).

The invention claimed is:

1. An electronic ballast for a luminous means, in a low-pressure discharge lamp, which is configured to be fed with electrical energy by an energy source, other than AC main current, and which contains at least one electronic switching element (Q1, Q2) for converting the fed-in electrical energy, characterized in that a microcontroller (IC1) drives the electronic switching element, wherein the electronic ballast is characterized in that one tap of a voltage divider (R3, R4, C9) is connected to one input of the microcontroller (IC1), by means of which tap the microcontroller configured to monitor the supply voltage.

2. An electronic ballast for a luminous means, in a low-pressure discharge lamp, which k configured to be fed with electrical energy by energy source, other than AC main current, and which contains at least one electronic switching element (Q1, Q2) for converting the fed-in electrical energy, characterized in that a microcontroller (IC1) drives the electronic switching element, wherein the electronic ballast with at least two switching elements, which are driven via in each case one output of the microcontroller, characterized in that the microcontroller emits pulse trains which are synchronized with one another at the two outputs, each pulse train comprising at least one pulse burst, and in that an operating frequency and a duty factor as a pulse burst interval is defined by the pulse bursts.

3. The electronic ballast as claimed in claim 2, characterized in that the operating frequency and/or the duty factor are variable.

4. The electronic ballast as claimed in claim 2, characterized in that the pulse burst interval can be varied by means of pulse width modulation at a frequency which is lower than the operating frequency.

5. The electronic ballast as claimed in claim 2, characterized in that the individual pulses are square-wave pulses, and in that a pulse at a second output follows a pulse at a first output.

6. The electronic ballast as claimed in claim 5, characterized in that a dead time, which is preferably variable, lies between the pulses at the two outputs.

* * * * *

UNITED STATES PATENT AND TRADEMARK OFFICE

CERTIFICATE OF CORRECTION

PATENT NO. : 8,013,542 B2
APPLICATION NO. : 11/920693
DATED : September 6, 2011
INVENTOR(S) : Endres It is certified that error appears in the above-identified patent and that said Letters Patent is hereby corrected as shown below:

Col. 8
In claim 2, please correct line 25 to read as follows:

"... , which is configured ..."

Signed and Sealed this
Twenty-ninth Day of November, 2011

David J. Kappos

David J. Kappos
*Director of the United States Patent and Trademark Office*